US007557322B2

(12) United States Patent
Adachi

(10) Patent No.: US 7,557,322 B2
(45) Date of Patent: Jul. 7, 2009

(54) SWITCH UNIT

(75) Inventor: Yukio Adachi, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 12/007,963

(22) Filed: Jan. 17, 2008

(65) Prior Publication Data

US 2008/0173530 A1 Jul. 24, 2008

(30) Foreign Application Priority Data

Jan. 19, 2007 (JP) ..... P2007-010369

(51) Int. Cl.
*H01H 21/00* (2006.01)

(52) U.S. Cl. ..... 200/558; 200/559; 200/561

(58) Field of Classification Search ..... 200/553, 200/556–563, 329, 339
See application file for complete search history.

(56) References Cited

U.S. PATENT DOCUMENTS 3,519,775 A * 7/1970 Weremey ..... 200/556
6,091,038 A * 7/2000 Murphy et al. ..... 200/563
6,633,013 B2 * 10/2003 Nishimura et al. ..... 200/559
6,756,556 B2 * 6/2004 Kubota et al. ..... 200/556
6,861,607 B2 * 3/2005 Kwong ..... 200/553
6,943,309 B2 * 9/2005 Huang ..... 200/329
6,963,039 B1 * 11/2005 Weng et al. ..... 200/302.1
7,009,127 B2 * 3/2006 Hoelzle et al. ..... 200/315
7,019,243 B2 * 3/2006 Tsuda et al. ..... 200/559
7,026,565 B1 * 4/2006 Lee ..... 200/339

FOREIGN PATENT DOCUMENTS

JP U-6-50204 7/1994

* cited by examiner

*Primary Examiner*—Michael A Friedhofer
(74) *Attorney, Agent, or Firm*—Morgan, Lewis & Bockius LLP

(57) ABSTRACT

In a switch unit, abutting portions are provided on a movable contact in such a manner as to be brought into contact with stepped portion of a switching control element, respectively, so that when the switching control element is operated to rock, the abutting portion elastically ride on the stepped portions, so as to impart a click to the rocking operation of the switching control element, whereby the click can be imparted to the rocking operation of the switching control element without requiring a clicking piece and a spring which are required in a conventional switch unit.

3 Claims, 5 Drawing Sheets

SWITCH UNIT

BACKGROUND OF THE INVENTION

The present invention relates to a switch unit which is improved in the construction to give a click to a switching control element which is operated to rock.

Conventionally, there have been switch units which are configured as is shown in FIG. 8. In those switch units, a switch case 1 is made up of a case lower body 1*a* and a case upper body 1*b*, and a switching control element 2 is supported on the case upper body 1*b* of the two bodies in such a manner as to rock clockwise and counterclockwise as viewed in the figure on a shaft portion 3. The switching control element 2 has a cylindrical portion 4 below the shaft portion 3, and a spring 5 and a clicking piece 6 are accommodated in the cylindrical portion 4.

A circuit board 7 is provided in such a manner as to be held between the case lower body 1*a* and the case upper body 1*b*, and pairs of stationary contacts 8, 9 are provided on the circuit board 7. In addition, a sheet 12, which is made of, for example, rubber, is provided, and this rubber sheet 12 has movable portions 12*a*, 12*b* which have, respectively, movable contacts 10, 11 which are adapted to be connected to and disconnected from the stationary contacts 8, 9, respectively.

A hole 13 is formed in a portion in the circuit board 7 which lies between the stationary contacts 8, 9, and the cylindrical portion 4 of the switching control element 2 passes through this hole 13. In addition, clicking recessed portions 14, 15 are formed on a bottom surface portion of the case lower body 1*a* which is where the cylindrical portion 4 ends which has passed through the hole 13, and a clicking piece 6 is brought into engagement with one (the recessed portion 14 in a state shown in the figure) of the clicking recessed portions so formed by virtue of a biasing force applied by the spring 5.

In this configuration, when the switching control element 2 is operated to rock clockwise, the movable portion 12*b* of the sheet 12 is pushed by the switching control element 2 to thereby bring the movable contact 11 into contact with the stationary contacts 9, whereas when the switching control element 2 is operated to rock counterclockwise, the movable portion 12*a* of the sheet 12 brings the movable contact 10 into contact with the stationary contacts 8. In addition, every time the switching control element 2 is operated to rock clockwise and counterclockwise in the figure, the clicking piece 6 moves to the recessed portion 14 and the recessed portion 15 in such a way as to reciprocate between the two recessed portions, and during this movement, the clicking piece 6 rides over an angular portion 16 to thereby impart a click to the rocking operation of the switching control element 2 (refer to, for example, JP-UM-A-6-50204).

In the case of the conventional switch unit, the clicking piece 6 and the spring 5 were necessary to impart the click to the rocking operation of the switching control element 2, and the number of components was increased by such an extent that the components concerned were involved and hence, the production costs were increased accordingly.

SUMMARY OF THE INVENTION

The invention has been made in view of the situations, and consequently, an object thereof is to provide a switch unit which can realize the impartation of a click to the rocking operation of a switching control element with a smaller number of components involved.

With a view to attaining the object, according to an aspect of the invention, there is provided a switch unit including: a switching control element that is provided so as to be operated to rock, and includes a stepped portion; a movable contact that moves in response to a rocking motion of the switching control element and includes an abutting portion to be brought into contact with the stepped portion; and a stationary contact to and from which the switching control element is connected and disconnected in response to a rocking operation of the switching control element, wherein when the switching control element is operated to rock, the abutting portion elastically rides on the stepped portion to give a click to the rocking operation.

According to the means described above, a click can be imparted to the rocking operation of the switching control element by the abutting portion of the movable contact and the stepped portions of the switching control element, whereby the can be imparted to the rocking operation of the switching control element without requiring the clicking piece and the spring which were necessary in the conventional switch unit.

DETAILED DESCRIPTION OF PREFERRED EMBODIMENTS

Hereinafter, a first embodiment of the invention (a first mode for carrying out the invention) will be described by reference to FIGS. 1 to 4.

Figure 1:
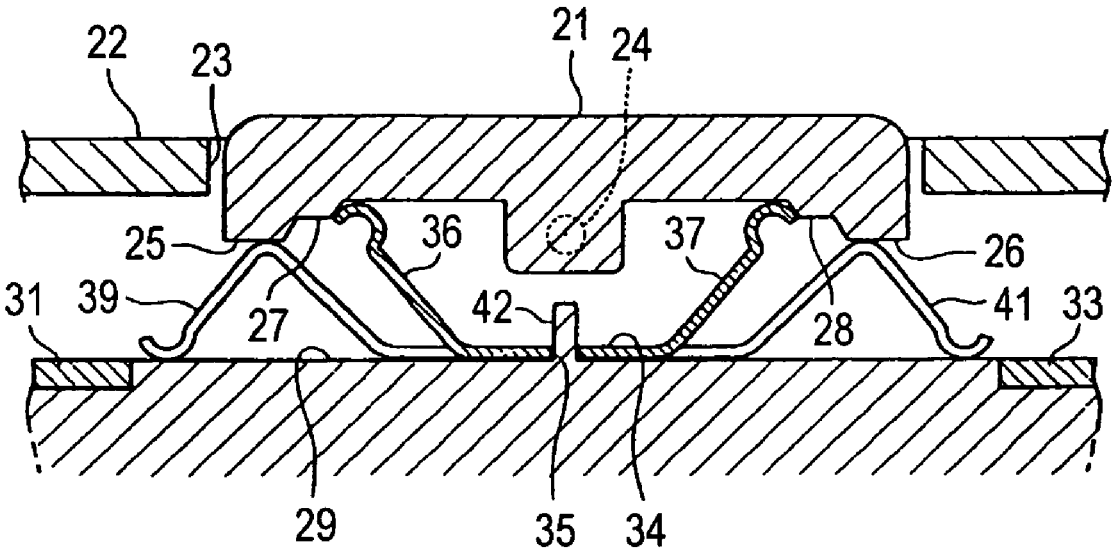
FIG. 1 is an overall vertical sectional view showing a first embodiment of the invention.

Firstly, a switching control element 21 is shown in FIG. 1, and this switching control element 21 is situated within an opening 23 in a switch case 22 and is supported on the switch case 22 at a central portion thereof by a shaft portion 24 in such a manner as to rock clockwise and counterclockwise as viewed in the figure.

Raised portions 25, 26 are formed, respectively, in left and right end portions, as viewed in the figure, on a lower surface of the switching control element 21, and stepped portions 27, 28 are formed in portions lying further inwards (towards the shaft portion 24) than the raised portions 25, 26, respectively. In this case, the raised portions 25, 26 are made to protrude further downwards than the stepped portions 27, 28.

Figure 2:
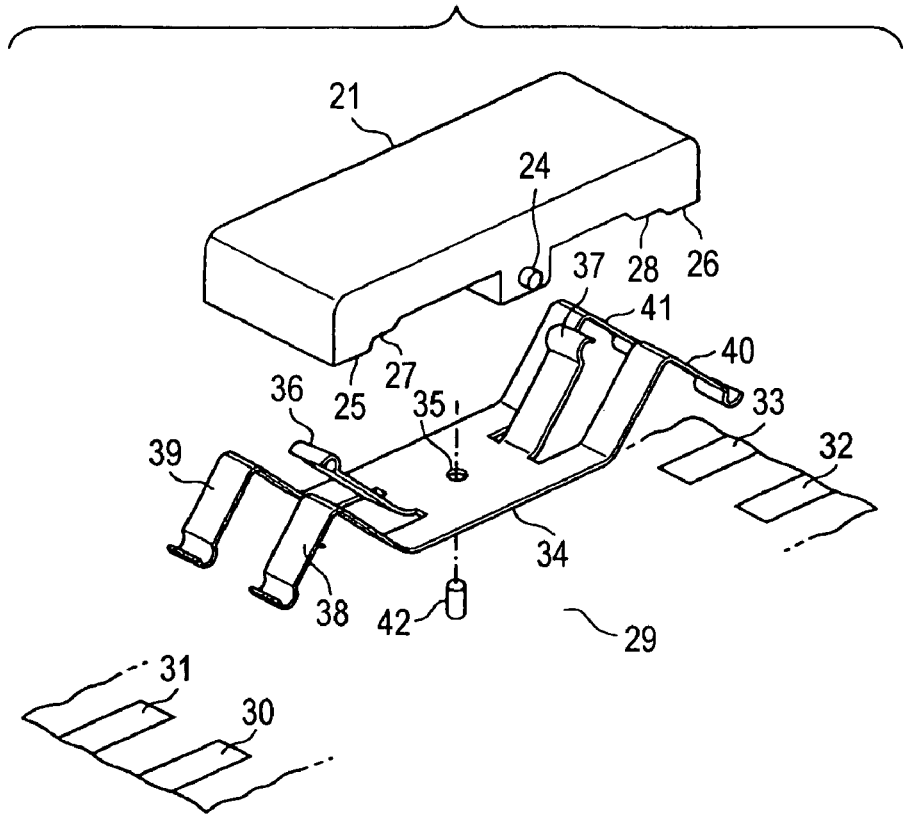
FIG. 2 is an overall exploded perspective view which excludes a switch case.

An insulator 29 is disposed below the switching control element 21, and as is also shown in FIG. 2, stationary contacts 30, 31 and stationary contacts 32, 33 are embedded in this insulator 29 in such a manner as to be spaced horizontally apart from each other with only upper surfaces thereof exposed from the insulator 29.

In addition, a movable contact 34 is mounted on an upper surface of the insulator 29 in such a manner as to be situated between the stationary contacts 30, 31 and the stationary contacts 32, 33. This movable contact 34 has a mounting hole 35 in a central portion thereof and also has on left- and right-hand sides of the mounting hole 35 tongue-shaped abutting portions 36, 37 which are made to rise obliquely therefrom. The movable contact 34 further has, as is shown in FIG. 2, front and rear contact piece portions 38, 39 and contact piece portions 40, 41 which are each bent into a substantially inverted V-like shape at left- and right-hand sides thereof. In this case, as is shown in FIG. 1, distal end portions of the abutting portions 36, 37 are made higher than apex portions of the contact piece portions 38 to 41, and the apex portions of the contact piece portions 38, 39 and the apex portions of the contact piece portions 40, 41 are made to lie further outwards than the distal end portions of the abutting portions 36, 37, respectively.

Then, this movable contact 34 is mounted in such a manner that the mounting hole 35 is fitted on a projection 42 on the insulator 29, and with the movable contact 34 mounted in such a state, the distal end portions of the abutting portions 36, 37 are brought into abutment, respectively, with the stepped portions 27, 28 on their sides which lie to face the shaft portion 24, and the apex portions of the contact piece portions 38, 39 and the apex portions of the contact piece portions 40, 41 are brought into abutment, respectively, with lower surfaces of the raised portions 25, 26 of the switching control element 21.

Here, in the case of the switch unit that is configured as has been described heretofore, the contact piece portions 38, 39 are spaced away from the stationary contacts 30, 31, respectively, and the contact piece portions 40, 41 are spaced away from the stationary contacts 32, 33, respectively, before the switching control element 21 is operated.

Figure 3:
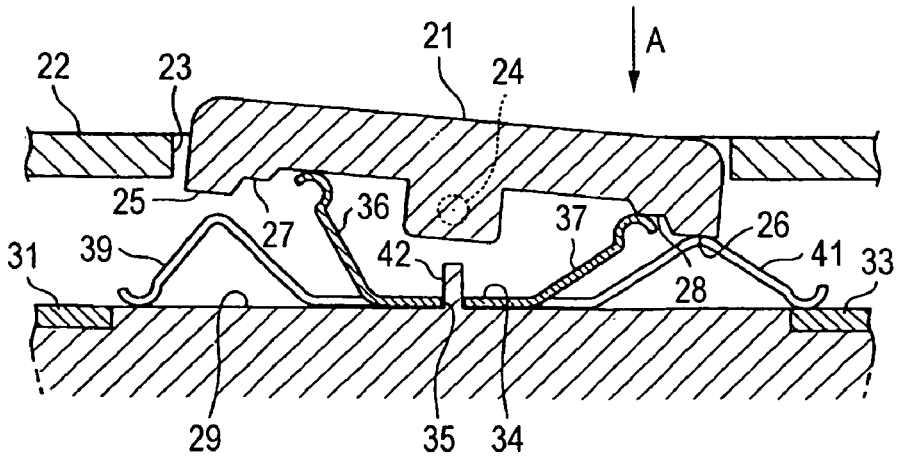
FIG. 3 is an overall vertical sectional view showing a state in which a switching control element is operated.

From this state, when a right-hand side of the switching control element 21 is now pushed down as indicated by an arrow A shown in FIG. 3, the switching control element 21 is operated to rock clockwise, which causes the raised portion 26 of the switching control element 21 to push the apex portions of the contact piece portions 40, 41, whereby the contact piece portions 40, 41 are caused to extend to thereby bring distal end portions of the contact piece portions 40, 41 into contact with the stationary contacts 32, 33, respectively. By this, the stationary contacts 32, 33 are bridged to allow for energization therebetween by the movable contact 34.

Figure 4:
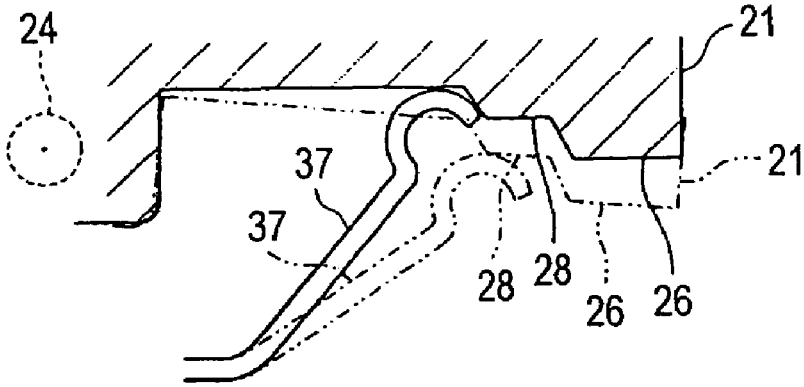
FIG. 4 is an enlarged vertical sectional view of a main part.

In addition, as this occurs, the abutting portion 37 of the movable contact 34 changes its position, as is shown in FIG. 4, from a position indicated by a solid line to a position indicated by a chain double-dashed line and elastically rides on the stepped portion 28 of the switching control element 21, whereby a click is imparted to the clockwise rocking operation of the switching control element 21 (the operation to generate energization between the stationary contacts 32, 33 by the movable contact 34).

Note that although not shown, when a left-hand side of the switching control element 21 is pushed, the switching control element 21 is operated to rock counterclockwise, which causes the raised portion 25 of the switching control element 21 to push the apex portions of the contact piece portions 38, 39, whereby the contact piece portions 38, 39 are caused to extend to thereby bring distal end portions of the contact piece portions 38, 39 into contact with the stationary contacts 30, 31, respectively. By this, the stationary contacts 30, 31 are bridged to allow for energization therebetween by the movable contact 34.

In addition, as this occurs, the abutting portion 36 of the movable contact 34 elastically rides on the stepped portion 27 of the switching control element 21, whereby a click is imparted to the counterclockwise rocking operation of the switching control element 21 (the operation to generate energization between the stationary contacts 30, 31 by the movable contact 34).

In this way, according to the configuration of this embodiment, the click can be imparted to the rocking operations of the switching control element 21 by the abutting portions 36, 37 of the movable contact 34 and the stepped portions 27, 28 of the switching control element 21, whereby the click can be imparted to the rocking operations of the switching control element 21 without requiring the clicking piece and the spring which were required in the conventional switch unit. Thus, the number of components involved can be decreased, and hence the production costs can be decreased.

Figure 5:
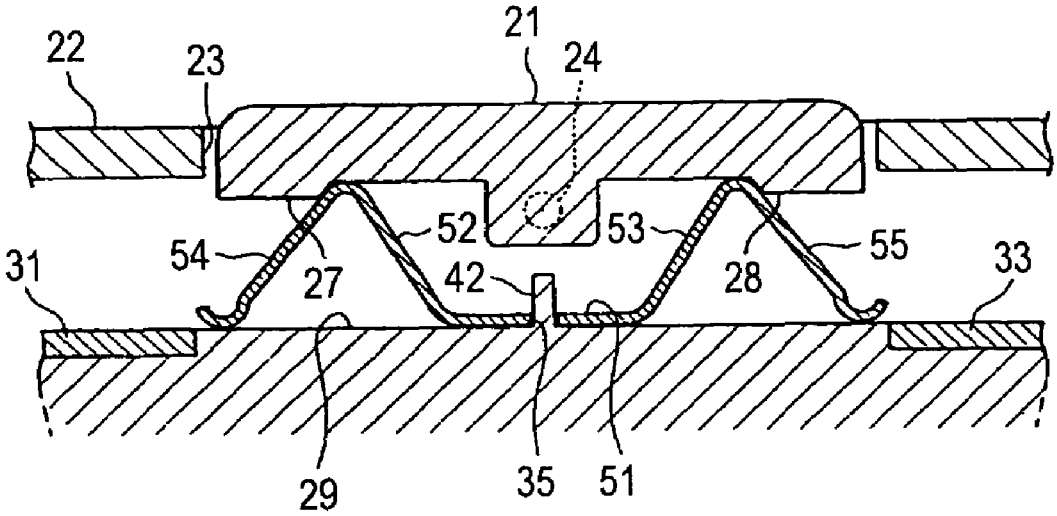
FIG. 5 is a view corresponding to FIG. 1, which shows a second embodiment of the invention.
Figure 6:
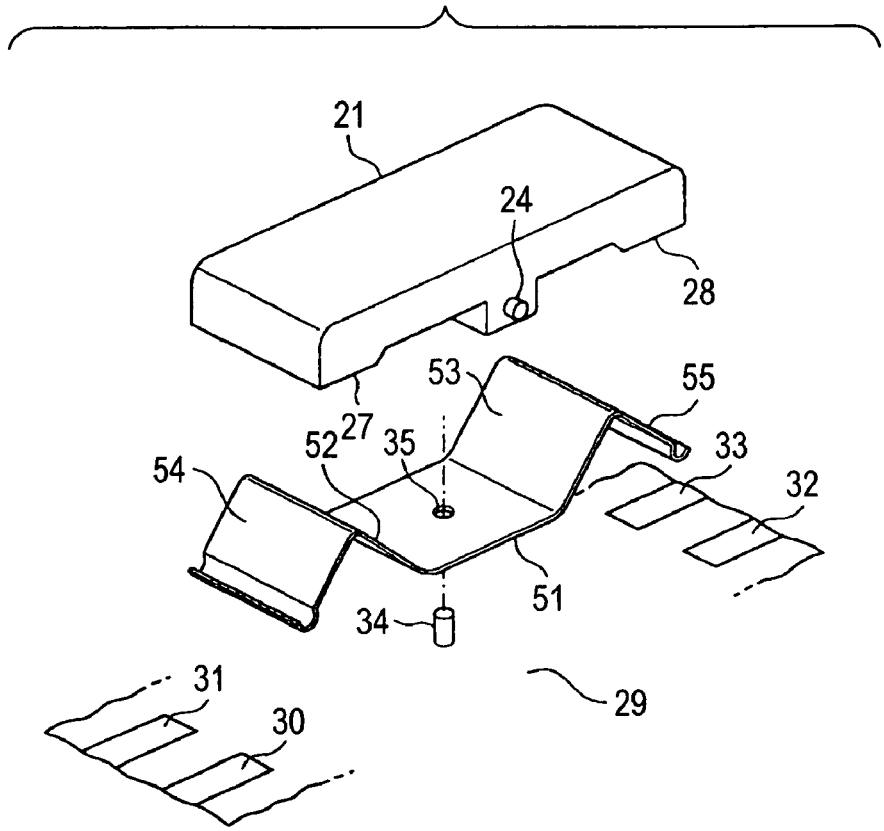
FIG. 6 is a view corresponding to FIG. 2.
Figure 7:
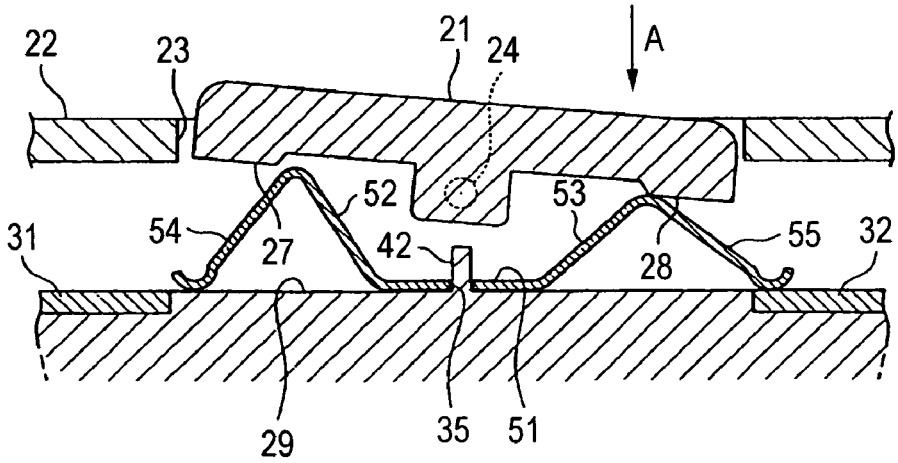
FIG. 7 is a view corresponding to FIG. 3.
Figure 8:
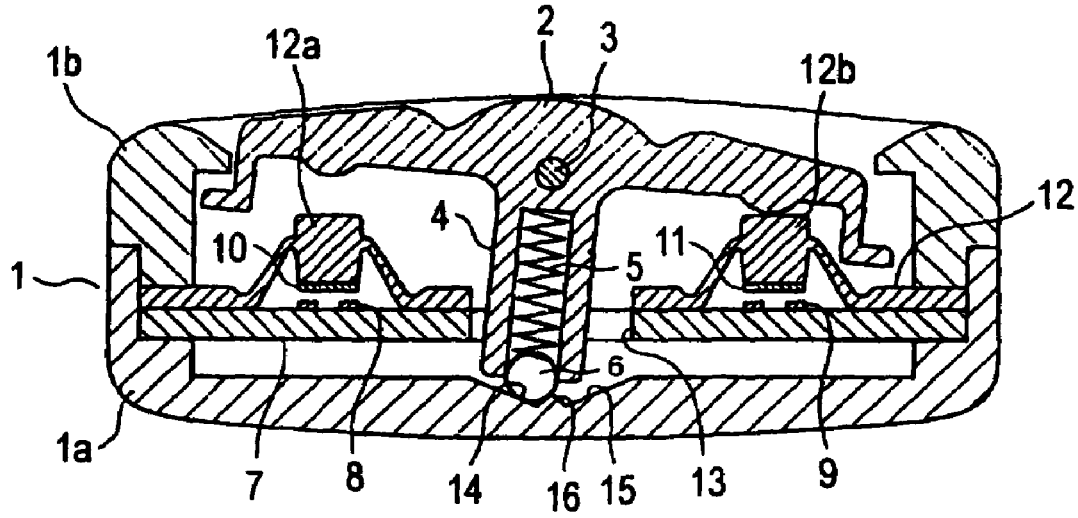
FIG. 8 PRIOR ART
FIG. 8 is a view corresponding to FIG. 1, which shows a conventional example.

In contrast to the first embodiment, FIGS. 5 to 7 show a second embodiment of the invention (a second mode for carrying out the invention), and like reference numerals are imparted to like portions to those of the first embodiment so as to omit the description thereof, only different portions being described herebelow.

In the case of the second embodiment, a movable contact 51 is employed in place of the movable contact 34, and in this movable contact 51, abutting portions 52, 53 are made so wide to include the abutting portions 36, 37, as well as the contact piece portions 38, 39 and the contact piece portions 40, 41, and contact piece portions 54, 55 are formed in such a manner as to extend from the abutting portions 52, 53, respectively. In short, it can be said that this second embodiment is such that the abutting portion 36 and the contact piece portions 38, 39 are formed into one piece, while the abutting portion 37 and the contact piece portions 40, 41 are formed into one piece.

In addition, in contrast to the first embodiment, a switching control element 21 is made to have only stepped portions 27, 28 (and does not have raised portions 25, 26), and as is shown in FIG. 7 which represents the operation of the second embodiment, when the switching control element 21 is operated to rock, the abutting portion 53 (the abutting portion 52) elastically rides on the stepped portion 28 (the stepped portion 27) so as to impart a click to the rocking operation of the switching control element 21, and the contact piece portion 55 (the contact piece portion 54) is caused to extend from the abutting portion 53 (the abutting portion 52) so as to be brought into contact with stationary contacts 32, 33 (stationary contacts 30, 31).

Thus, also according to the second embodiment, the click can be imparted to the rocking operations of the switching control element 21 by the abutting portions 53, 54 of the movable contact 51 and the stepped portions 27, 28 of the switching control element 21, whereby since the click can be imparted to the rocking operations of the switching control element 21 without requiring the clicking piece and the spring which were required in the conventional switch unit, the number of components involved can be decreased, and hence the production costs can be decreased.

In addition, the invention is not such as to be limited to only the embodiments which have been described above and are illustrated in the accompanying drawings and hence can be modified to be carried out as required without departing from the spirit and scope of the invention.

What is claimed is:

1. A switch unit, comprising:

a switching control element that is provided so as to be operated to rock, and includes a stepped portion;

a movable contact that moves in response to a rocking operation of the switching control element and includes an abutting portion to be brought into contact with the stepped portion;

a stationary contact to and from which the movable contact is connected and disconnected in response to the rocking operation, wherein the movable contact includes a contact piece portion whose distal end portion is slidable over an insulator and the stationary contact; and an intermediate portion between the distal end portion and a base portion of the contact piece portion is brought into contact with the switching control element, wherein when the switching control element is operated to rock, the abutting portion elastically rides on the stepped portion to give a click to the rocking operation.

2. The switch unit according to claim 1, wherein the movable contact includes a contact piece portion which is separated from the abutting portion and connected to and disconnected from the stationary contact in response to the rocking operation.

3. The switch unit according to claim 1, wherein the abutting portion is formed with a contact piece portion so as to extend from the abutting portion, the contact piece portion being connected to and disconnected from the stationary contact in response to the rocking operation.

* * * * *